United States Patent [19]

Matsuo et al.

[11] Patent Number: 4,836,909

[45] Date of Patent: Jun. 6, 1989

[54] PROCESS OF THERMALLY CRACKING HEAVY PETROLEUM OIL

[75] Inventors: Itaru Matsuo, Matsudo; Yuzo Takahashi, Kimitsu; Hideo Hashimoto, Sagamihara; Toru Takatsuka, Yokohama; Takeru Iimori, Ichihara; Hitoshi Maekawa, Chiba; Tamotsu Ito, Ichihara; Yoshihiko Shohji, Yokohama; Ryuzo Watari, Yamato; Hiroshi Aida, Tokyo, all of Japan

[73] Assignee: Research Association for Residual Oil Processing, Japan

[21] Appl. No.: 94,492

[22] Filed: Sep. 9, 1987

Related U.S. Application Data

[63] Continuation-in-part of Ser. No. 931,075, Nov. 17, 1986, abandoned.

[30] Foreign Application Priority Data

Nov. 25, 1985 [JP] Japan ..... 60-264119
Dec. 20, 1985 [JP] Japan ..... 60-288217

[51] Int. Cl.[4] ..... C10G 51/02; C10G 9/16

[52] U.S. Cl. ..... 208/72; 208/48 R; 208/50; 208/56; 208/67; 208/75; 208/48 AA; 208/131; 208/40

[58] Field of Search ..... 208/48 R, 50, 56, 67, 208/72, 75, 48 AA

[56] References Cited

U.S. PATENT DOCUMENTS

| | | | |
|---|---|---|---|
| 1,865,189 | 6/1932 | Howard | 208/72 |
| 1,979,437 | 11/1934 | Behimer | 196/60 |
| 2,063,505 | 12/1936 | Huff | 196/49 |
| 2,316,334 | 4/1943 | Hirsch | 208/50 |
| 2,953,514 | 9/1960 | Wilkins | 208/48 AA |
| 3,342,723 | 9/1967 | Godar | 208/48 AA |
| 3,681,231 | 8/1972 | Alpert et al. | 208/48 AA |
| 3,928,170 | 12/1975 | Takahashi et al. | 208/128 |
| 4,178,228 | 12/1979 | Chany | 208/72 |
| 4,477,334 | 10/1984 | Ceomi et al. | 208/75 |
| 4,487,686 | 12/1984 | Gomi et al. | 208/50 |
| 4,581,124 | 4/1986 | Gomi et al. | 208/39 |
| 4,604,185 | 8/1986 | McConaghy Jr. et al. | 208/56 |
| 4,619,756 | 10/1986 | Dickerkian | 208/48 R |
| 4,663,022 | 5/1987 | Goomi et al. | 208/67 |
| 4,673,486 | 6/1987 | Orihashi et al. | 208/128 |

*Primary Examiner*—H. M. S. Sneed
*Assistant Examiner*—Helane Myers
*Attorney, Agent, or Firm*—Lorusso & Loud

[57] ABSTRACT

A process of thermally cracking a heavy petroleum oil wherein the heavy petroleum oil is treated successively in a cracking furnace and then in a perfect mixing type tank reactor. The thermal cracking in the cracking furnace is performed at a temperature at the outlet of the cracking furnace of 450°-520° C. with a conversion of at least 60-75% of the overall conversion rate while the thermal cracking in the tank reactor is performed at a temperature of 400°-450° C. a pressure of from ambient pressure to 1 kg/cm$^2$ for a period of time of less than 30 minutes but not less than 10 minutes while feeding steam having a temperature of 435°-700° C. to the tank reactor in an amount of 8-20% by weight of the heavy petroleum oil fed to the cracking furnace.

2 Claims, 2 Drawing Sheets

PROCESS OF THERMALLY CRACKING HEAVY PETROLEUM OIL

CROSS-REFERENCE TO RELATED APPLICATION

This application is a continuation-in-part of U.S. Ser. No. 931,075 filed Nov. 17, 1986, now abandoned.

TECHNICAL FIELD

This invention relates to a process of continuously thermally cracking a heavy petroleum oil.

PRIOR ART

Various methods are known for thermally cracking a heavy petroleum oil and for producing a liquid pitch and a cracked light oil. For example, U.S. Pat. No. 4,477,334 proposes a method of thermally cracking a heavy hydrocarbon oil with the use of one cracking furnace and two or more perfect mixing type reactors so as to obtain a pitch suitable as a fuel and a cracked light oil. This method is advantageous because the thermal cracking can be conducted in a continuous manner while effectively preventing the occurrence of coking troubles. However, this method is not fully satisfactory from the standpoint of economy and apparatus efficiency because the method requires the use of two or more perfect mixing type reactors operated at temperatures which are gradually increased in the later stages.

U.S. Pat. No. 4,581,124 discloses a method in which a heavy feed stock is thermally cracked with the use of a combination of one cracking furnace and one tank reactor. In this method, since the conversion in the cracking furnace is suppressed to a low degree and the thermal cracking is mainly effected in the tank reactor, coking troubles are apt to occur in the tank reactor. To prevent the occurrence of coking troubles in the tank reactor, a mixture of mesophase pitch and matrix pitch (isotropic pitch) is continuously withdrawn from the tank reactor and is introduced into a separator for the sepration of the mixture into the mesophase pitch and the matrix pitch. The mesophase pitch thus separated is recovered while the matrix pitch thus separated is recycled to the tank reactor to keep the ratio of the matrix pitch to the mesophase pitch within the tank reactor high. Thus, the prior art method has a drawback because the operation in the separating step becomes complicated due to the necessity for keeping the ratio of the matrix pitch to the mesophase pitch high.

U.S. Pat. No. 3,928,170 also discloses a method in which a heavy feed stock is thermally cracked in a single cracking furnace and a single tank reactor connected to the downstream of the cracking furnace. In the tank reactor, the heavy feed stock which has been pretreated in the cracking furnace is subjected to cracking poly-condensation by being brought into direct contact with a gaseous heat transfer medium such as steam. One problem involved in this method is that the reaction in the tank reactor should be continued for a long period of time, i.e. an average dwell time of 30 minutes or more, practically 1 hour or more. Another problem is that the use of either a large amount of the heat transfer medium (about 30% by weight or more of the feed stock) or a high temperature heat transfer medium (as high as 1500° C.) is required in order to prevent the occurrence of coking troubles.

OBJECT

It is the prime object of the present invention to provide a process of thermally cracking a heavy petroleum oil which is devoid of the drawbacks of the conventional technique and which is free of coking troubles.

Another object of the present invention is to provide an economical process of thermally cracking a heavy petroleum oil with the utilization of a combination of one thermal cracking furnace and one tank reactor and with a small amount of steam at a low temperature while preventing the occurrence of coking troubles in the tank reactor.

CONSTITUTION

In accordance with the present invention, there is provided a process of thermally cracking a heavy petroleum oil wherein the heavy petroleum oil is treated with the use of a combination of one cracking furnace and one perfect mixing type tank reactor, characterized in that the thermal cracking in the cracking furnace is performed at a temperature at the outlet of the cracking furnace of 450°–520° C. with a conversion of 60–75% of the total conversion and that the thermal cracking in the tank reactor is performed at a temperature of 400°–450° C. and a pressure of from ambient pressure to 1 $kg/cm^2G$ for a period of time of less than 30 minutes but not less than 10 minutes while feeding steam having a temperature of 435°–700° C. to the tank reactor for direct contact with the heavy petroleum oil introduced from the cracking furnace, the feed ratio by weight of the steam to the heavy petroleum oil fed to the cracking furnace being 0.08–0.2.

BRIEF DESCRIPTION OF THE DRAWINGS

The accompanying drawings illustrate flow diagrams for carrying out the process according to the present invention.

DETAILED DESCRIPTION OF THE INVENTION

Figure 1:
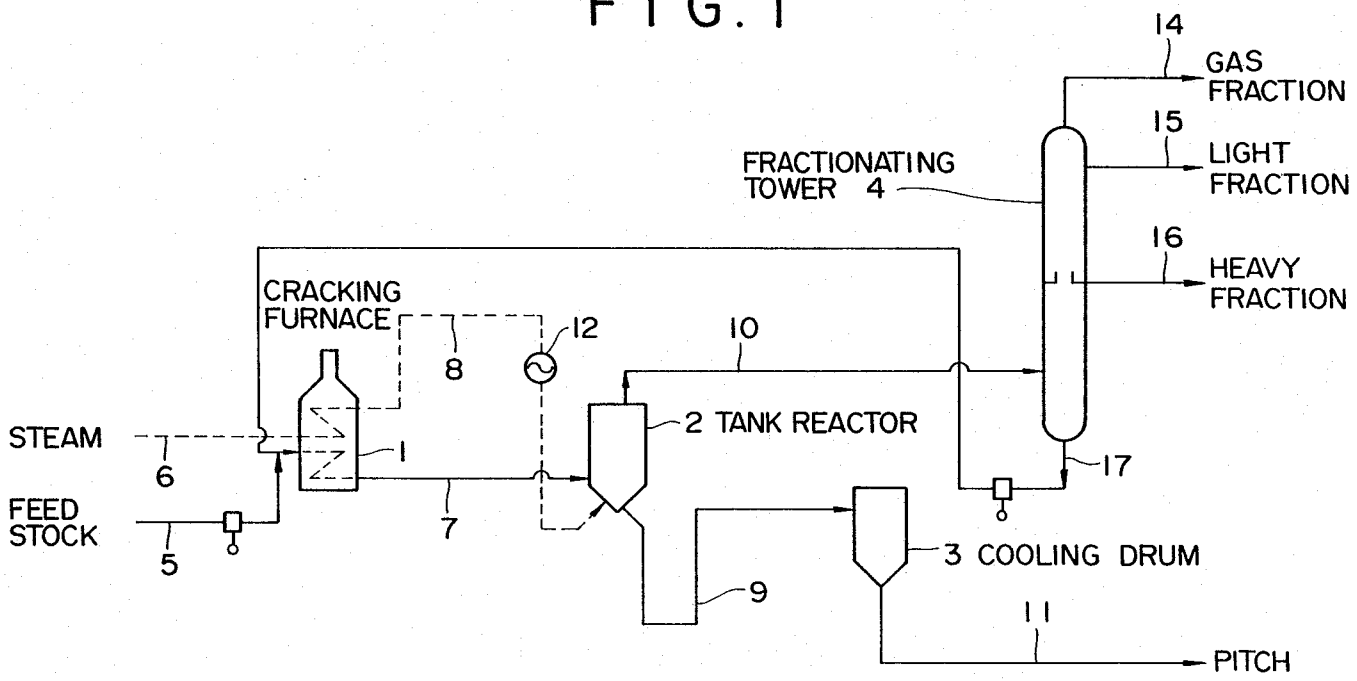
FIG. 1 shows one embodiment and FIG. 2 shows another embodiment of the present invention, wherein the reference numeral 1 denotes a cracking furnace, 2 a perfect mixing type tank reactor, 3 a pitch cooler and 4 denotes a fractionating tower.

Examples of the heavy petroleum oils used in the present invention include atmospheric and vacuum residues of petroleum crude oils, various cracking residues, asphalt products from solvent deasphalting and native natural asphalt.

When such a heavy hydrocarbon oil is subjected to a thermal cracking treatment in a known manner with the use of a combination of one cracking furnace and one tank reactor, mesophase is formed in a large amount. The mesophase tends to coalesce with each other to grow to large particles. Namely, carbon is apt to form so that coking troubles are liable to occur. Upon study by the present inventors, it has been found that such coking troubles in the tank reactor can be effectively prevented from occurring by increasing the conversion in the cracking furnace. When the thermal cracking product obtained in the cracking furnace with a high conversion is treated in the succeeding tank reactor, the mesophase produced in the tank reactor is small in size and excellent in dispersibility. Therefore, precipitation of carbon (coking) hardly occurs and, hence, coking troubles in the tank reactor are prevented.

The process according to the present invention will now be described in detail below. The process is conducted with the use of a combination of one cracking furnace and one perfect mixing type tank reactor. In this process, the feed stock is thermally cracked in the cracking furnace until 60–75% of the total thermal cracking conversion is reached.

The term "total thermal cracking conversion" used in the present specification is intended to mean the total conversion accomplished in the cracking furnace and the tank reactor and is defined by the following equation:

$$R=[(A-C)/A]\times 100 \quad \text{(I)}$$

$$=[(A-B)/A+(B-C)/A]\times 100 \quad \text{(II)}$$

wherein

R: Total thermal cracking conversion (%)

A: The weight of the components in the feed stock which have a boiling point of at least 538° C.

C: The weight of the components contained in the thermal cracking product which are obtained in the tank reactor and which have a boiling point of at least 538° C.

B: The weight of the components contained in the thermal cracking product which are obtained obtained in the cracking furnace and which have a boiling point of at least 538° C.

$[(A-B)/A]\times 100$: Conversion (%) in the cracking furnace $[(B-C)/A]\times 100$: Conversion (%) in the tank reactor The total thermal cracking conversion is selected according to the kind of the feed stock and the like. Generally speaking, the total conversion required for obtaining pitch having a softening point of 160°–220° C. and a volatile matter content of 30–45 wt % is 65–75%.

The reaction conditions adopted in the cracking furnace include a temperature at the outlet of the cracking furnace of 450°–520° C., preferably 490°–500° C., and a pressure of from ambient pressure to 20 kg/cm$^2$, preferably from ambient pressure to 1 kg/cm$^2$G. In the cracking furnace, the thermal cracking is conducted so that the conversion in this step is 60–75% of the total thermal cracking conversion. The conversion in the cracking furnace may be controlled by the control of the reaction temperature, reaction pressure and residence time.

The reaction conditions in the perfect mixing type tank reactor involve a reaction temperature of 400°–450° C., preferably 435°–450° C., a reaction pressure of from ambient pressure to 1 kg/cm$^2$G, preferably from ambient pressure to 0.5 kg/cm$^2$ and a reaction time (average dwell time) of less than 30 minutes but not less than 10 minutes, preferably 10–26 minutes. The use of the reaction temperature of 435°–450° C. is especially preferred for reasons of eliminating coking troubles resulting from the formation of mesophase. The perfect mixing type tank reactor is operated under a reduced pressure or under a partial pressure of hydrocarbons of 200–700 mmHg by feeding an inert gas such as steam. The steam to be fed to the tank reactor should have a temperature of 435°–700° C. The steam is fed to the tank reactor in an amount of 8–20%, preferably 8–12% by weight of the heavy petroleum oil fed to the cracking furnace.

The thermal cracking in the perfect mixing type tank reactor is conducted so that the conversion falls within the range of 25–40% of the total thermal cracking conversion. The conversion can be controlled by controlling the reaction temperature, partial pressure of hydrocarbon and reaction time. When the reaction temperature and pressure are kept constant, the conversion can be controlled by control of the reaction time. In the perfect mixing type tank reactor, liquid pitch and gaseous product including cracked light oil are produced. The liquid pitch thus produced contain mesophase. The amount of the mesophase is relatively small, i.e. generally 30 vol % or less, especially 15–25 vol %. The mesophase has a particle size of 20–50 μm and is excellent in dispersibility in the pitch. The mesophase is hardly carbonized (formation of coke).

The cracking furnace may be, for example, an external heating type tubular reactor while the tank reactor may be, for example, of a type equipped with an agitating apparatus within the reactor. If desired, the tank reactor can be further provided with a wet wall system or a scraper to keep the inside wall of the reactor clean. Any known cracking furnace and the tank reactor may be suitably used for the purpose of the present invention.

In the process according to the present invention, a cracked heavy oil produced in the process may be recycled to the cracking furnace to increase the overall yield of cracked light oil. The cracked heavy hydrocarbon oil suitably used for this purpose has generally a boling point of 340° C. or more. The amount of the cracked oil recycled is 0.1–0.3 part by weight per one part by weight of the feed stock. Too large an amount of the recycled heavy cracked oil causes the increase of the cracked gas and pitch and reduction of total liquid yield.

The process according to the present invention will be described in more detail with reference to FIG. 1. The feed stock is fed to a cracking furnace 1 through a line 5. In this case, before being introduced into the cracking furnace 1, the feed stock may be mixed with a cracked heavy oil recycled through a line 17 from the bottom of a fractionating tower 4, if desired. The feed stock which is mixed with the cracked heavy oil is subjected to a thermal cracking treatment in the cracking furnace 1 and the resulting cracked product is fed through a line 7 to a perfect mixing type tank reactor 2 where it is subjected to a further thermal cracking treatment. To the bottom of the tank reactor 2 is supplied through a line 8 high temperature steam (with a temperature of about 435°–700° C.) which has been fed through a line 6 and heated in the cracking furnace 1 and, if necessary, by means of a steam super heater 12. The steam serves to heat a liquid pitch contained in the reactor 2 for the further thermal cracking thereof, to accelerate the stripping of volatile components from the liquid pitch and to decrease the partial pressure of hydrocarbons in the space within the reactor 2. The steam supplied to the reactor 2 is not necessarily high temperature steam heated by means of a steam super heater 12. When steam which is not heated by means of the super heater is supplied to the reactor 2, the steam serves to strip volatile components from the liquid pitch and to decrease the partial pressure of hydrocarbons in the space within the reactor 2.

The gas components including the cracked oil produced in the reactor 2 are introduced into a fractionating tower 4 through a line 10, whereas the liquid pitch obtained in the reactor 2 is discharged therefrom through a line 9 and introduced into a pitch cooling drum 3 where the liquid pitch is cooled for the termination of the reaction. The liquid pitch in the cooling drum 3 is discharged therefrom through a line 11 and recovered as a pitch product. The pitch product has a volatile matter content of 30–45 wt % and a softening point of 160°–220° C. and is suitable for use as a fuel pitch.

The gas components introduced into the fractionating tower 4 through the line 10 are fractionated into a cracked gas discharged through a line 14, a cracked light oil (boling point of $C_5$-370° C.) discharged through a line 15, a cracked heavy oil (boiling point of 370°–538° C.) discharged through a line 16 and a recycling cracked heavy oil (boiling point of 538° C. or more) discharged through a line 17. The cracked heavy oil discharged through the line 17 is recycled for mixing with the feed stock to be fed to the cracking furnace 1.

The process shown in FIG. 1 can be varied and modified in various manners. For example, the fractionating tower 4 may be composed of a combination of two or more fractionating towers. Further, instead of directly feeding the feed stock to the cracking furnace, the feed stock can be previously introduced into the fractionating tower 4, introducing the mixture of the feed stock and the cracking heavy oil obtained in the bottom of the fractionating tower 4 into the cracking furnace 1. Furthermore, the cracked heavy oil discharged through the line 16 may be added to the cracked heavy oil discharged from the bottom of the tower 4 for mixing with the feed stock. The recycling of the cracked heavy oil for mixing with the feed stock is not essential and can be omitted.

The above-described first process according to the present invention uses a combination of one cracking furnace and one perfect mixing type tank reactor for the thermal cracking treatment of petroleum heavy hydrocarbon oil and permits one to continuously obtain a sufficiently lightened, cracked oil and a pitch which is suitable as a fuel and which contains a volatile matter in the amount of 30–45 wt %, without encountering coking troubles in the tank reactor. In the conventional thermal cracking treatment of heavy petroleum hydrocarbon oils using a combination of one cracking furnace and one perfect mixing type tank reactor, the mesophase produced in the tank reactor tends to coalesce to form precipitates of carbon, namely tends to encounter coking troubles. For this reason, steam has been used in a large amount to lower the concentration of hydrocarbons within the reactor. In contrast, the mesophase in the pitch produced according to the process of the present invention, in which the thermal coking conversion rate in the cracking furnace is made high, has a small particle size, hardly coalesces, and is excellent in dispersibility in the pitch, so that precipitation of carbon scarcely occurs.

In addition to the above-described merits, the present invention has the following advantages:

(1) Since majority of the reaction heat may be supplied from the cracking furnace, the amount of the heat gas medium can be reduced so that the operation cost can be considerably reduced.

(2) Since the feed to be subjected to the thermal cracking treatment in the tank reactor is a product obtained by thermal cracking of a feed stock at a high conversion in a cracking furnace in which the reaction time is not distributed, it is possible to reduce the reaction load in the tank reactor. Therefore, the tank reactor can be constructed into a small sized reactor. Moreover, the pitch obtained in the tank reactor has uniform properties and is low in content of highly polycondensed components such as mesophase and quinoline insolubles. Such a pitch when used as binder for the preparation of metallurgical coke exhibits excellent properties as a binder and when used as a fuel is excellent in perfect combustibility.

Since, in the process of the present invention, a greater part of the thermal cracking is effected in the cracking furnace, the reaction conditions in the cracking furnace are inevitably severe. Therefore, coking troubles would occur in the cracking furnace depending on the kind of the feed stock. Such coking troubles in the cracking furnace can be effectively prevented by admixing the feed stock with an aromatic solvent having a solubility parameter of 8.5–10.0, preferably 8.9–10.0, and being substantially free of toluene insolubles. An aromatic solvent having a solubility parameters of less than 8.5 could be used for the purpose of the present invention if it is used in a large amount. Thus, the use of such a solvent is disadvantageous from the economic point of view.

The term "solubility parameter" used in the present specification is defined by the following equation:

$$\delta = -11.8[1/(1+C/H)]+14.8 \quad \text{(III)}$$

wherein

δ: Solubility parameter

C/H: Carbon to hydrogen atomic ratio of the hydrocarbon

The solubility parameter defined by the above equation slightly differs from that containing a function of temperature in the strict sence of the term. However, the above equation represents effective approximation for the determination of the solubility parameter of hydrocarbon compounds (D. M. Riggs. R. J. Diefendorf: "14th Biennial conf. on Carbon", Extended Abstract, U.S.A. p. 407, 1979). Solubility parameters of typical petroleum hydrocarbons are exemplified in the following table.

TABLE 1

| Substance | Solubility Parameter (δ) |
|---|---|
| n-Heptane | 6.6 |
| n-Nonane | 6.7 |
| Cyclohexane | 6.9 |
| Benzene | 8.9 |
| Toluene | 8.5 |
| Naphthalene | 9.6 |
| Bachaquero vacuum residue | 7.91 |
| Arabian vacuum residue | 7.76 |
| Cinta vacuum residue | 7.41 |
| Heptane solubles | <9.0 |
| Heptane insolubles and toluene solubles | 8.9–9.5 |
| Toluene insolubles and quinoline solubles | 9.4–10.6 |
| Mesophase carbon | 10.0–12.5 |

The aromatic solvent used in the present invention should be substantially free of toluene insolubles. A solvent containing toluene insolubles will cause coking troubles because the toluene insolubles undergo thermal hysteresis in the tracking furnace to form higher molecular weight components. The aromatic solvent used in the present invention is also required to contain a component which is liquid under the reaction conditions. Thus, a solvent which becomes gaseous under the reaction conditions is not suitable even if it has a solubility parameter of above 8.5, because it fails to show a solvent effect.

The solvent is used in an amount so that the amount of components of the solvent which are liquid under the reaction conditions is 1–50 wt %, preferably 5–20 wt %, based on the weight of the feed stock. The amount and the kind of the solvent are preferably selected so that a mixture of the solvent and the feed stock, when it is subjected to the reaction conditions in the cracking furnace, has a fraction which has a boling point higher than the boiling point calculated on the normal pressure basis [T(760)] and which shows a solubility parameter of at least 7.9. The term "boiling point calculated on the normal pressure basis [T(760)]" used herein represents the condition of the flush of the cracked product in the cracking furnace and depends on the temperature and partial pressure of hydrocarbons as shown in the following equation:

$$T(760) = \frac{748.1A}{1/(T_p + 459.6) + 0.2145A - 0.0002867} - 459.6 \quad \text{(IV)}$$

wherein $T(760)$: Boiling point calculated on normal pressure basis (°F.)

$T_p$: Operation temperature (°F.) $\dfrac{-C_2 - \sqrt{C_2^2 - 4C_3(C_1 - \ln P)}}{2C_3}$ where P = Partial pressure of hydrocarbons (atm)

$C_1 = 8.4682$ $C_2 = -6625.2$ $C_3 = 0.21528 \times 10^6$

Examples of suitable aromatic solvent used in the present invention include fluid catalytic cracking residues (solubility parameter: 8.9–9.5), ethylene bottoms (solubility parameter: 9.0–9.9) and liquified solvents recycled in coal liquefaction process (solubility parameter: 8.5–9.1). The fraction having a boiling point of 420°–538° C. (solubility parameter: 9.2–9.4) obtained by distilling a fluid catalytic cracking residue for the removal of super heavy fraction and light fraction is especially preferably used in the present invention.

The process according to the present invention using an aromatic solvent will now be described below with reference to FIG. 2, in which corresponding parts have been designated by the same reference numerals.

The feed stock is fed to the cracking furnace 1 through a line 5. I this case, before being introduced into the cracking furnace 1, the feed stock is mixed with a solvent supplied through a line 20 and, if necessary, a cracked heavy oil recycled from the bottom of the fractionating tower 4. The feed stock which is mixed with the solvent and the cracked heavy oil is subjected to a thermal cracking treatment in the cracking furnace 1 and the resulting cracked product is fed through a line 7 to the perfect mixing type tank reactor 2 where it is subjected to a further thermal cracking treatment. To the bottom of the tank reactor 2 is supplied through a line 8 high temperature steam (with a temperature of about 435°–700° C.). The gas components including the cracked oil produced in the tank reactor 2 are introduced into the fractionating tower 4 through a line 10, whereas the liquid pitch obtained in the tank reactor 2 is discharged therefrom through a line 9 and introduced into the cooler 3 wherein the liquid pitch is cooled and the reaction is terminated. The gas components including the aromatic solvent in the cooler 3 are withdrawn therefrom and are introduced into the fractionating tower 4 through lines 21 and 22. The liquid pitch in the cooler 3 is discharged therefrom through a line 11 and recovered as a pitch product.

The gas components introduced into the fractionating tower 4 through the line 10 are fractionated into a cracked gas discharged through a line 14, a cracked light oil (boiling point of $C_5$-370° C.) discharged through a line 15, a cracked heavy oil (boiling point of 370°–538° C.) discharged through a line 16 and a recycling cracked heavy oil (boiling point of 538° C. or more) discharged through a line 17. The cracked heavy oil discharged through the line 17 is recycled for mixing with the feed stock fed through the line 5.

Figure 2:
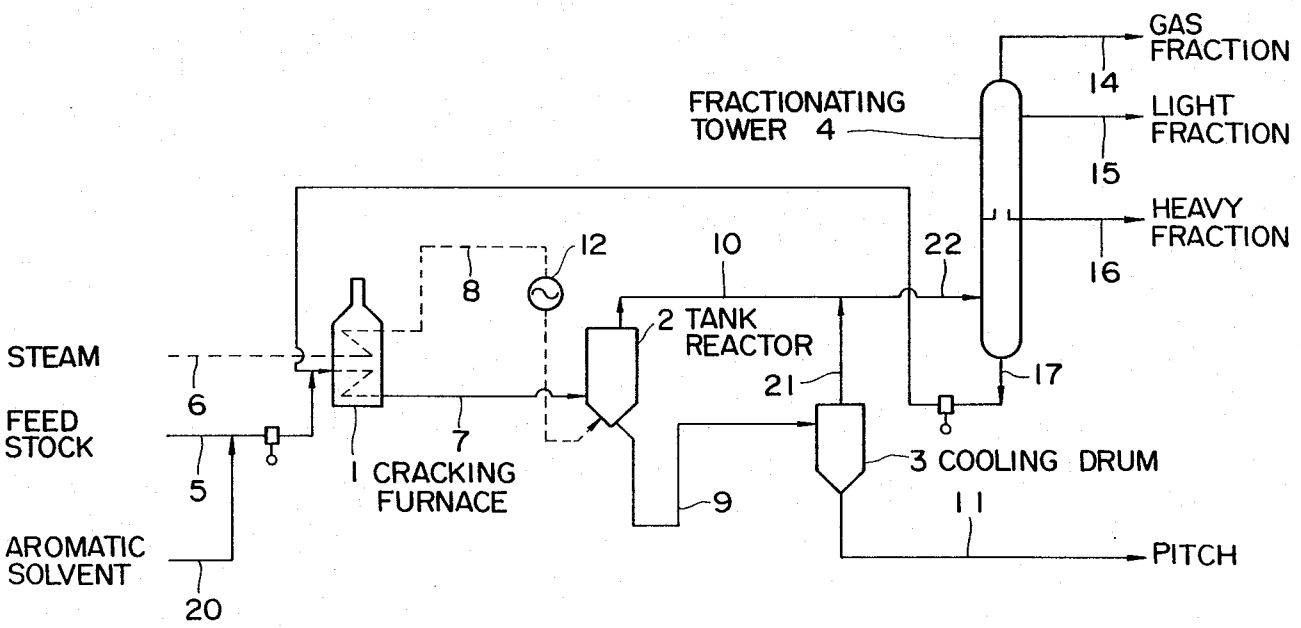

The process shown in FIG. 2 uses a combination of a cracking furnace and a perfect mixing type tank reactor for the thermal cracking treatment of petroleum heavy hydrocarbon oil and permits one to continuously obtain a sufficiently lightened, cracked oil and a pitch which is suitable as a fuel and which contains a volatile matter in the amount of 30–45 wt %, without encountering coking troubles in the tank reactor. In the conventional thermal cracking treatment of heavy petroleum hydrocarbon oils, it is necessary to suppress the conversion in the cracking furnace to a low level and to use a plurality of tank reactors. In the present invention, on the other hand, the feed stock may be thermally cracked at a high conversion rate while preventing coking troubles by using a combination of one cracking furnace and one perfect mixing type tank reactor.

The present invention will described in more detail by way of examples.

Example 1

Using the apparatus as shown in FIG. 1, a heavy petroleum oil having the properties shown in Table 2 was treated for thermal cracking. Thus, the feed stock was fed to a cracking furnace at a feed rate of 300 kg/hr where it was thermally cracked and the resulting thermally cracked product was introduced into a perfect mixing type reactor (stirring tank reactor with an inside diameter of 500 mm and a height of 3000 mm) to which steam was supplied from the bottom for further thermal cracking. The the extent of conversion in the cracking furnace and the tank reactor was varied by varying the reaction time, with the total conversion being kept constant (about 67%). The pitch products obtained were examined for their coking tendency in the perfect mixing type reactor, the results of which are summarized in Table 3.

TABLE 2

| Properties of Feed Stock | |
|---|---|
| Specific gravity (15/4° C.) | 1.021 |
| Molecular weight | 934 |
| Heptane insolubles (wt %) | 8.93 |
| Conradson carbon residue (wt %) | 20.8 |
| Elementary analysis (wt %) | |
| Carbon | 84.56 |
| Hydrogen | 10.37 |
| Sulfur | 3.95 |
| Nitrogen | 0.51 |

TABLE 3

| Experiment No. | Conversion (%) Cracking Furnace | Conversion (%) Tank Reactor | Properties of Pitch: Particle size of Mesophase (μm) | Properties of Pitch: Coking Tendency |
|---|---|---|---|---|
| 1 | 30 | 70 | 100< | great |
| 2 | 45 | 55 | 50–100 | fair |
| 3 | 60 | 40 | 30–50 | none |
| 4 | 75 | 25 | 20–30 | none |

The coking tendency was determined as follows: Mesophase in the pitch was observed by polarizing microscope to evaluate the coking tendency by the particle size of the mesophase unit and the degree of coalescence. Evaluation was made according to the following ratings.

None: No coking

Fair: Coking occurred slightly

Great: Coking occurred considerably

Example 2

A mixed oil (solubility parameter: 8.1) composed of 80 parts by weight of a feed stock (a vacuum bottom from a mixed crude composed of Middle East and Venezuelan crudes) having the properties shown in Table 4 and 20 parts by weight of a solvent (a fraction with a boiling point of between 420° and 538° C. from a fluid bed catalytic cracking residue) having the properties shown in Table 5 was fed to a cracking furnace at a feed rate of 1.2 kg/hour where it was thermally cracked at a temperature of 95° C. and a pressure of 1.0 kg/cm$^2$G. The resulting cracked product was introduced into a perfect mixing type tank reactor (inside volume: 1.2 liters) from the bottom of which steam was supplied, where it was further thermally cracked at a temperature of 420° C. and a partial pressure of hydrocarbons of 340 mmHg with an average reisdence time of 85 min. The liquid phase of the product in the cracking furnace was considered to contain about 13% by weight of the solvent in terms of T(760).

TABLE 4

| Properties of Feed Stock | |
|---|---|
| Specific gravity (15/4° C.) | 1.0317 |
| Residual carbon (wt %) | 21.1 |
| Solubility parameter | 7.8 |

TABLE 5

| Properties of Solvent | |
|---|---|
| Specific gravity (15/4° C.) | 1.125 |
| Residual carbon (wt %) | 4.8 |
| Toluene insolubles (wt %) | 0.0 |
| Solubility parameter | 9.3 |

The above treatment was continued for 120 hours. During the operation, neither increase in pressure for feeding the feed stock nor increase in weight of the reactor tube of the cracking furnace were observed, indicating that coking did not occur in the cracking furnace. Substantially no coking was found to occur in the tank reactor, too.

The yield of the pitch whose properties were as shown in Table 6 was 28.9 wt % based on the mixed oil feed. During the course of the thermal cracking, a portion of the cracked product from the cracking furnace was sampled to determine the conversion. The conversion in the cracking furnace was thus found to be 42.7%. The product oil from the tank reactor was also analyzed to reveal that the total conversion was 69.6%.

TABLE 6

| Properties of Pitch | |
|---|---|
| Softening point (°C.) | 166 |
| Volatile matter content (wt %) | 42.9 |
| n-Heptane insolubles (wt %) | 73.20 |
| Toluene insolubles (wt %) | 51.8 |
| Quinoline insolubles (wt %) | 20.3 |

Example 3

The heavy petroleum oil feed stock shown in Table 2 was treated in the cracking apparatus shown in FIG. 1 under various reaction conditions shown in Table 7. After the reaction, coking tendency was observed and quinoline-insoluble content was measured. The results are also summarized in Table 7. In Table 7, Tests 4 and 5 represent comparative tests.

TABLE 7

| | Test 1 | Test 2 | Test 3 | Test 4 | Test 5 |
|---|---|---|---|---|---|
| Cracking furnace | | | | | |
| Temperature (°C.) | 495 | 485 | 490 | 490 | 490 |
| Pressure (kg/cm$^2$G) | 3.0 | 3.0 | 3.0 | 3.0 | 3.0 |
| Conversion (%) | 51.0 | 44.7 | 44.7 | 44.7 | 51.0 |
| Tank Reactor | | | | | |
| Temperature (°C.) | 435 | 445 | 440 | 440 | 430 |
| Pressure (kg/cm$^2$G) | 0.1 | 0.1 | 0.4 | 0.4 | 0.3 |
| Steam/Oil ratio (wt/wt) | 0.12 | 0.16 | 0.13 | 0.15 | 0.16 |
| Porg (mmHg) | 319 | 308 | 473 | 368 | 313 |
| Time (minutes) | 10.2 | 15.0 | 25.2 | 48.0 | 36.0 |
| Conversion (%)*1 | 73.5 | 65.4 | 66.2 | 63.0 | 73.0 |
| Softening Point of pitch | 185 | 190 | 185 | 245 | 210 |
| Coking tendency | none | none | none | great | fair |
| QI (wt %) | 15.8 | 21.5 | 23.0 | 52.4 | 32.8 |

*1Conversion in the cracking furnace based on total conversion.

We claim:

1. A continuous process of thermally cracking a heavy petroleum oil wherein the heavy petroleum oil is treated with the use of a combination of one cracking furnace and one perfect mixing tank reactor, said process consisting essentially of the steps of:

(a) thermally cracking in the cracking furnace the heavy petroleum oil at a temperature at the outlet of the cracking furnace of 490°–500° C. with a conversion of 60–75% of the total conversion in both the cracking furnace and the tank reactor;

(b) discharging the thermally cracked product from the cracking furnace and introducing same into the tank reactor for thermally cracking same at a temperature of 435°–450° C. and a pressure of from ambient pressure to 0.5 kg/cm$^2$G for a period of time of 10–26 minutes while feeding steam having a temperature of 435°–700° C. to the tank reactor for direct contact with the thermally cracked product introduced from the cracking furnace, the feed ratio by weight of the steam fed to the tank reactor to the heavy petroleum oil fed to the cracking furnace being 0.08–0.12;

(c) discharging a portion of the liquid phase in the tank reactor to recover a pitch product;

(d) discharging a portion of the gas phase in the tank reactor and introducing same into a separation tower for fractionating same into gas, light and heavy fractions and a bottom fraction; and (e) recycling said bottom fraction to the cracking furnace.

2. A process according to claim 1, wherein the heavy petroleum oil is fed to the cracking furnace in the form of a mixture with an aromatic solvent which has a solubility parameter of 8.5–10.0, which is substantially free of toluene insolubles and which consists of components which are liquid under the reaction conditions.

* * * * *